US005802194A

United States Patent [19]

Yamagishi et al.

[11] Patent Number: 5,802,194

[45] Date of Patent: Sep. 1, 1998

[54] STEREO LOUDSPEAKER SYSTEM WITH TWEETERS MOUNTED ON ROTATABLE ENLONGATED ARMS

[75] Inventors: Makoto Yamagishi, Tokyo; Yutaka Kagawa, Kanagawa; Akihiro Akiyama, Kanagawa; Kazuo Ichikawa, Kanagwa, all of Japan

[73] Assignee: Sony Corporation, Tokyo, Japan

[21] Appl. No.: 914,497

[22] Filed: Aug. 19, 1997

Related U.S. Application Data

[63] Continuation of Ser. No. 424,506, filed as PCT/JP94/01649 Oct. 3, 1994 published as WO95/10163 Apr. 13, 1995, abandoned.

[30] Foreign Application Priority Data

Oct. 1, 1993 [JP] Japan ..... 5-247141

[51] Int. Cl.[6] ..... H04R 25/00

[52] U.S. Cl. ..... 381/188; 181/144; 381/24; 381/90; 381/182; 381/205

[58] Field of Search ..... 381/88, 90, 158, 381/188, 189, 205, 182, 24; 181/156, 145, 196, 197, 198, 199

[56] References Cited

U.S. PATENT DOCUMENTS

| | | | |
|---|---|---|---|
| 3,689,709 | 9/1972 | Salmansohn et al. | 179/182 R |
| 4,199,657 | 4/1980 | Lane | 181/145 |
| 4,517,416 | 5/1985 | Goossens | 181/144 |
| 4,850,452 | 7/1989 | Wolcott | 181/144 |
| 4,882,760 | 11/1989 | Yee | 381/90 |
| 4,926,486 | 5/1990 | Barsumian | 381/152 |
| 4,953,223 | 8/1990 | Householder | 381/188 |
| 5,025,885 | 6/1991 | Froeschile | 181/156 |
| 5,519,178 | 5/1996 | Ritto | 181/199 |

*Primary Examiner*—Curtis A. Kuntz
*Assistant Examiner*—Rexford N Barnie
*Attorney, Agent, or Firm*—Jay H. Maioli

[57] ABSTRACT

A speaker system has a first baffle (2) supporting a first speaker unit for producing sounds in a first frequency range (low frequencies), at least one second baffle (27L), (27R) supporting a second speaker unit for producing sounds in a second frequency range which is higher than the first frequency range (middle and/or high frequencies), the second baffles (27L), (27R) being smaller than the first baffles (2). The second baffle (27L), (27R) are spaced a predetermined distance from the first baffle (2). The speaker system has a reduced baffle effect, and increases direct sounds radiated directly from the speaker units, as compared with indirect sounds radiated backwards from a baffle, thereby improving frequency characteristics in the middle frequencies and providing excellent sound image localization.

9 Claims, 15 Drawing Sheets

FIG. 17

| Tipes of Pipe | E (GPa) | $\rho \times 10^3$ ($Kgm^{-3}$) | $\sqrt{E/\rho}$ (m) | Q | Sound Quality |
|---|---|---|---|---|---|
| Aluminum Pipe | 70.3 | 2.69 | 5100 | 2000 3000 | △ |
| Iron Pipe | 210 | 7.86 | 5200 | About 1000 | △ |
| Brass Pipe | 106 | 8.6 | 3500 | 2000~3000 | △ |
| Carbon Fiber Pipe | 50 | 1.6 | 5500 | 100~200 | ○ |
| PP Pipe | 0.6 | 0.9 | 810 | About 10 | × |
| Vibroisolating Copper Pipe | 200 | 8 | 5000 | 500 | ○ |

FIG. 18

| Types of Pipe | Resisitance/m | Sound Quality |
|---|---|---|
| Metal Pipe | 50mΩ | × |
| Carbon Fiber Pipe | 170Ω | ○ |
| PP Pipe | ∞ | ○ |

STEREO LOUDSPEAKER SYSTEM WITH TWEETERS MOUNTED ON ROTATABLE ENLONGATED ARMS

This is a continuation of application Ser. No. 08/424,506 filed Jun. 26, 1995, now abandoned.

TECHNICAL FIELD

The present invention relates to a speaker system designed to reduce the baffle effect of a speaker.

BACKGROUND ART

Generally, the front panel of a speaker cabinet comprises a baffle which produces a baffle effect due to sounds radiated directly from the front side of a speaker unit and sound waves radiated backwards of the baffle when the diaphragm of the speaker unit vibrates.

The baffle effect will be described below with reference to FIG. 1 of the accompanying drawings which shows a speaker system that serves as a basis for the present invention. In FIG. 1, the speaker system has a cabinet 101 including a baffle 102 as its front panel in the shape of a square having sides each having a length L. The baffle 102 supports a speaker unit 103 for producing sounds in low frequencies and a speaker unit 104 for producing sounds in middle and high frequencies.

The length L of each of the sides of the baffle 102 depends on the frequency, and the baffle 102 reflects a high frequency among certain frequencies due to the baffle effect. Specifically, $\lambda$ (wavelength) is calculated as $\lambda=2L$.

If the length L of each of the sides of the baffle 102 is 0.34 m, then since the velocity v of sound waves is 340 m/sec., the frequency f at the time $\lambda=2\times0.34=0.68$ m is given as $f=v/\lambda=340/0.68=500$ (Hz).

Consequently, the baffle 102 whose sides each have the length L adds waves of indirect sounds reflected on the rear surface of the baffle 102 at frequencies higher than 500 Hz, as indicated by a sound pressure vs. frequency characteristic curve 105 in FIG. 2 of the accompanying drawings.

In FIG. 2, the vertical axis represents the sound pressure (dB) and the horizontal axis represents the frequency (Hz). The frequency characteristic curve 105 which is shown by the solid line in FIG. 2 indicates that peaks and valleys of about 6 dB are produced in the frequency characteristic curve 105 in a frequency range of from 500 Hz to 10 kHz due to reflections added from the baffle 102. An area shown hatched in FIG. 2 which is created by subtracting the solid-line curve from a dotted-line curve 106 that represents the baffle effect totally free of reflections is responsible for deteriorating the quality of reproduced sounds. In a higher frequency range, e.g., in a frequency range higher than 10 kHz, the frequency characteristic curve 105 is flat because no baffle effect is caused in that frequency range.

It is an object of the present invention to provide a speaker system which is capable of reducing the baffle effect produced by the baffle in order to increase the proportion of direct sounds as compared with the proportion of indirect sounds, and thereby improve the frequency characteristics and sound quality in a middle frequency range.

DISCLOSURE OF THE INVENTION

A speaker system according to the present invention has a first baffle supporting a speaker unit for producing sounds in low frequencies and a second baffle supporting a speaker unit for producing sounds in middle and/or high frequencies, which is spaced a predetermined distance from the first baffle. With this arrangement, the baffle effect of the speaker system is reduced, and the speaker system produces increased direct sounds radiated directly from the speaker units as compared with indirect sounds radiated rearwards from the baffles, thereby improving the frequency characteristics in a middle frequency range and providing excellent sound image localization.

BRIEF DESCRIPTION OF THE DRAWINGS

FIG. 17 is a table of properties of various pipes and sound qualities achieved thereby; and FIG. 18 is a table of resistances of various pipes and sound qualities achieved thereby.

BEST MODE FOR CARRYING OUT THE INVENTION

A speaker system according to the present invention will hereinafter be described in detail with reference to the drawings.

Figure 3:
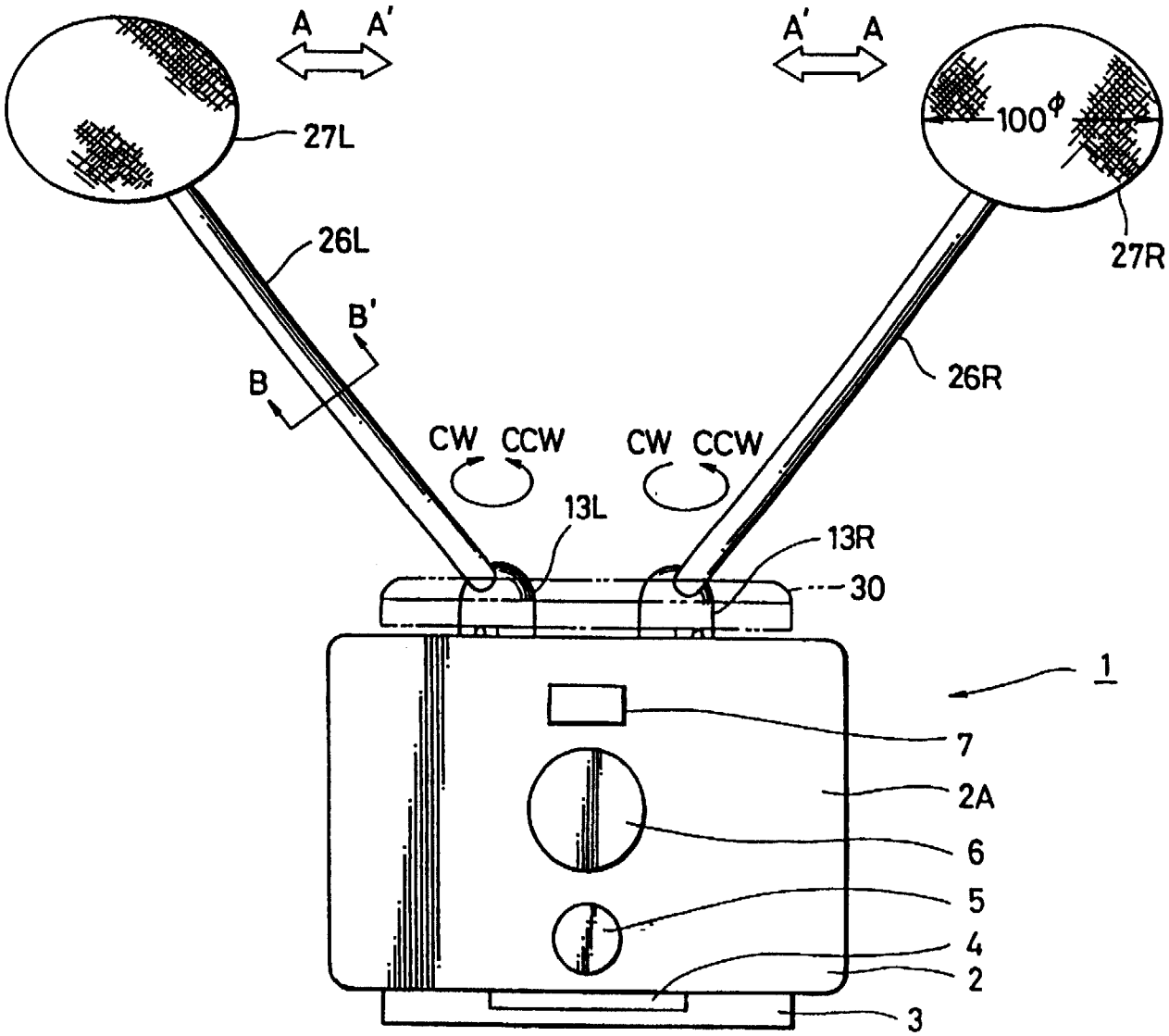
FIG. 3 is a front elevational view of a speaker system according to the present invention.
Figure 4:
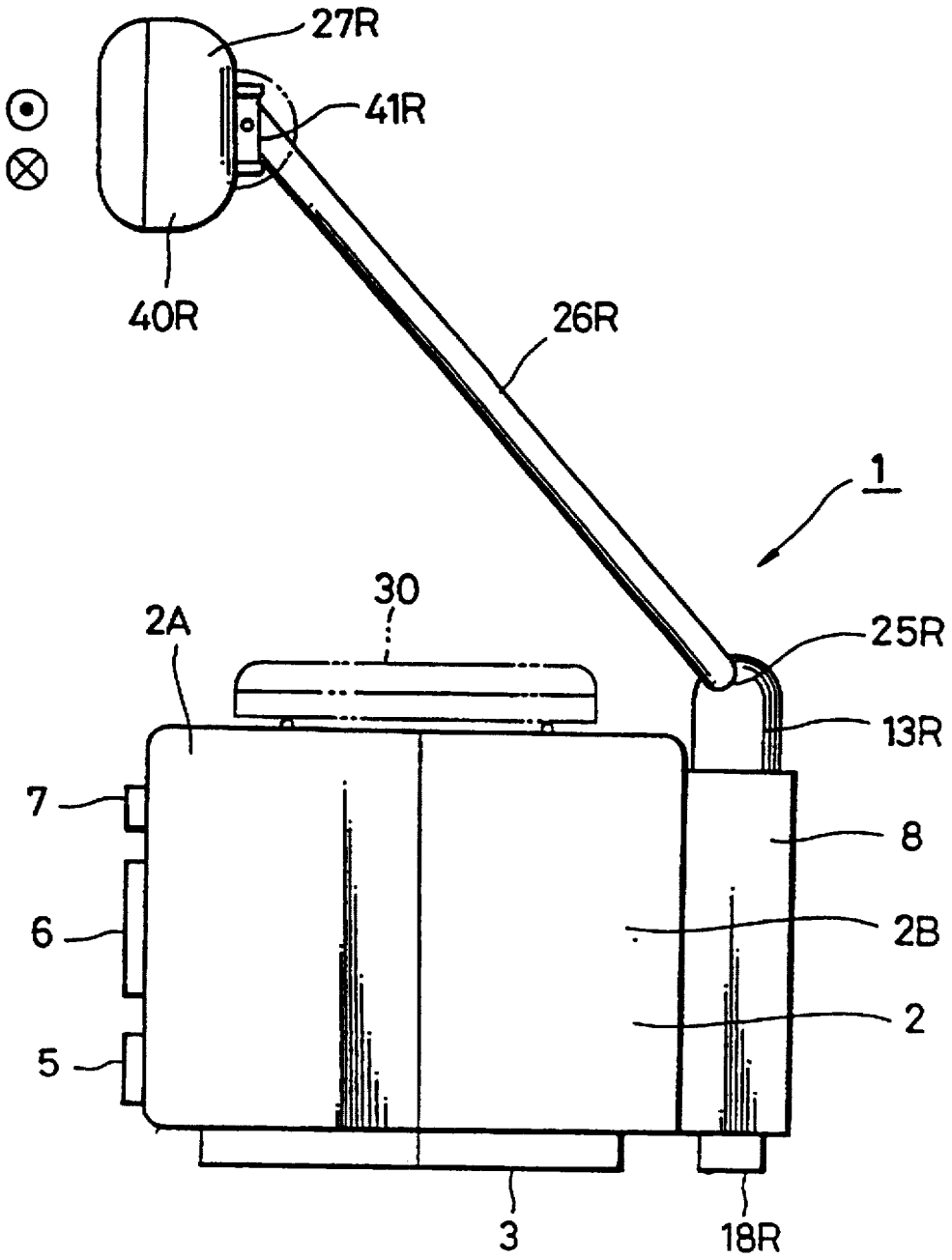
FIG. 4 is a side elevational view of the speaker system according to the present invention.
Figure 5:
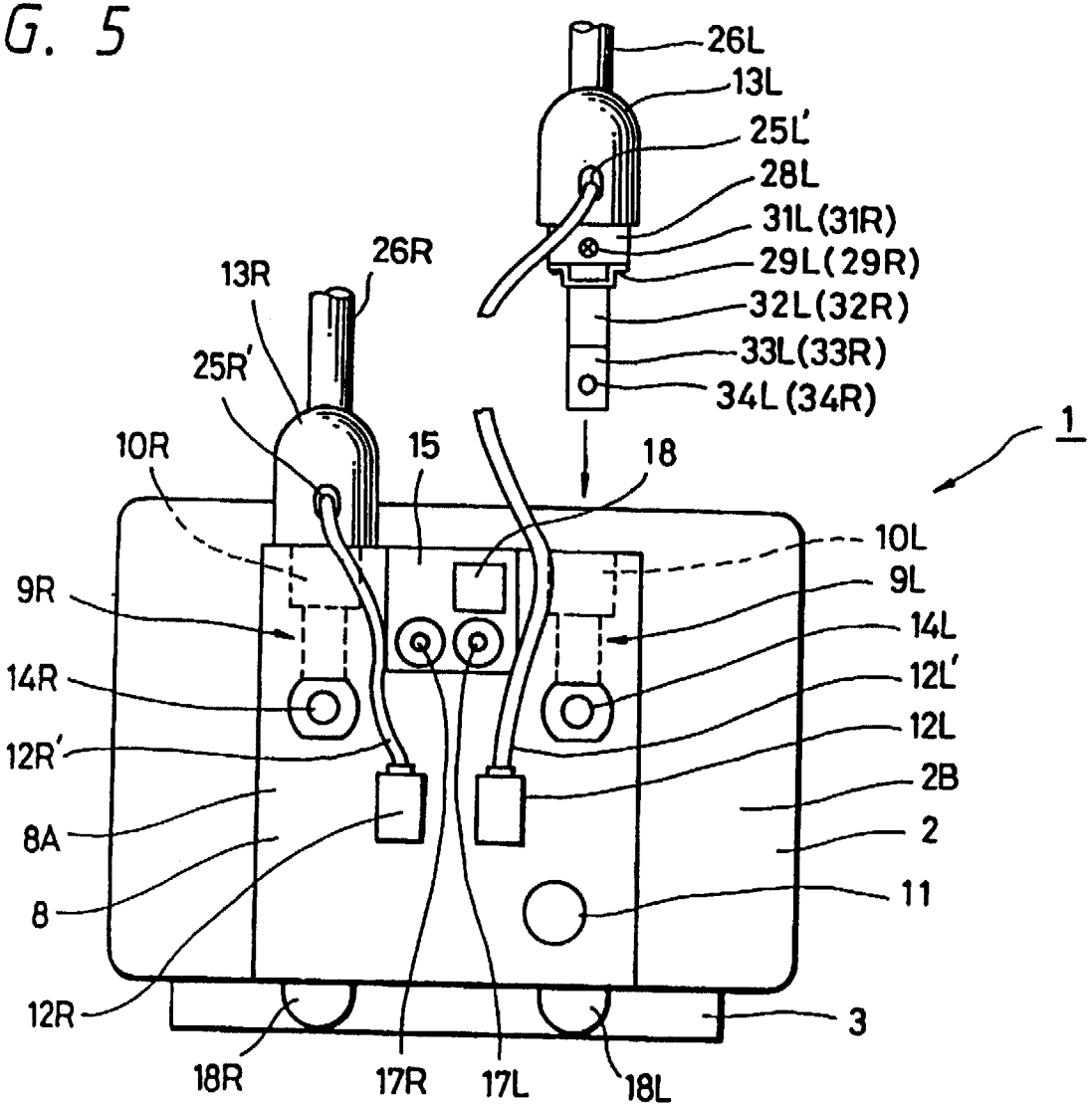
FIG. 5 is a rear elevational view of a portion of the speaker system according to the present invention.
Figure 6:
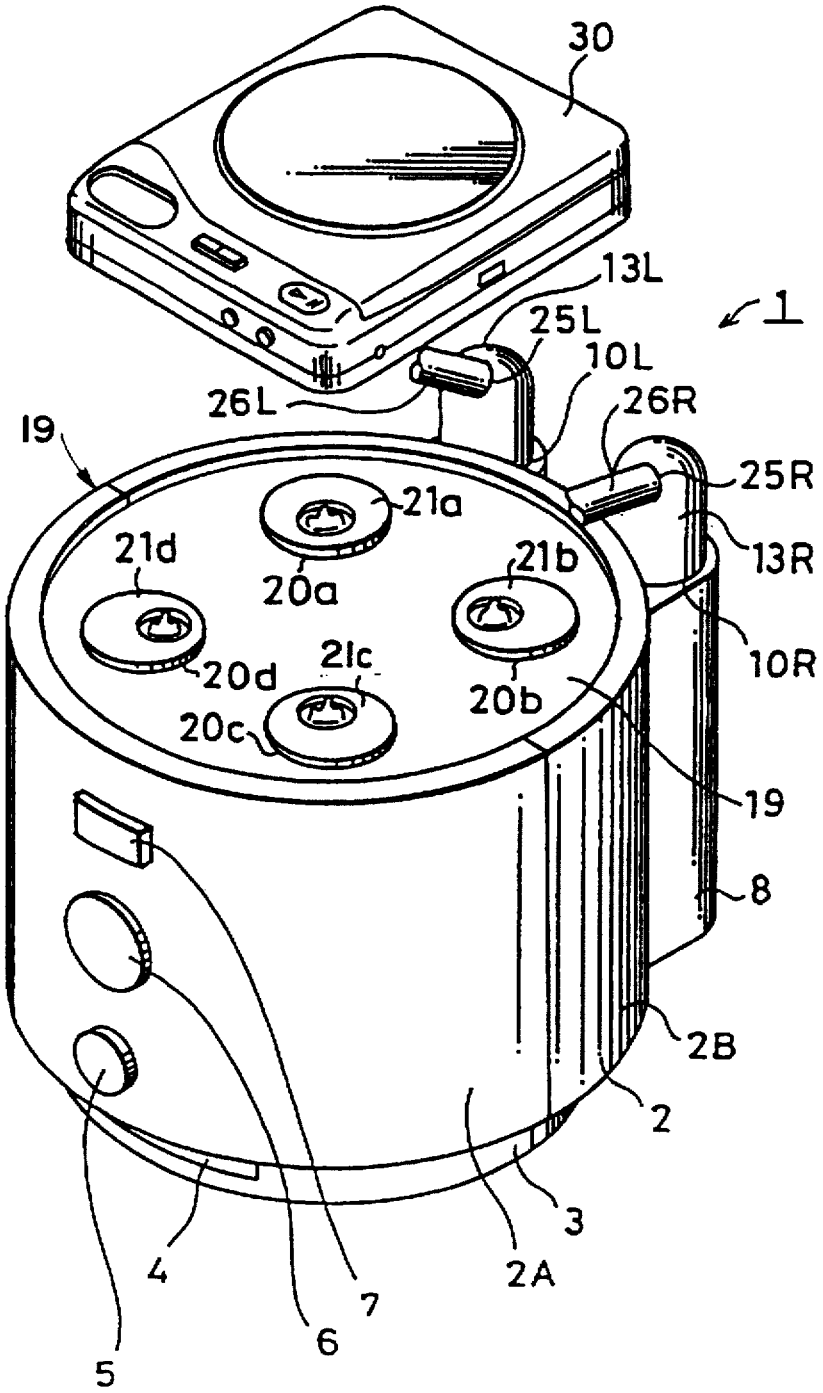
FIG. 6 is a perspective view of a portion of the speaker system according to the present invention.

FIGS. 3 through 5 show a speaker system 1 according to the present invention as a whole. As shown in FIGS. 4 and 6, the speaker system 1 has a cabinet 2 of synthetic resin which comprises front and rear half members 2A, 2B, respectively, each of a semicylindrical shape that are combined with each other into a cylindrical configuration having an elliptical flat surface as shown in FIG. 6.

Figure 7:
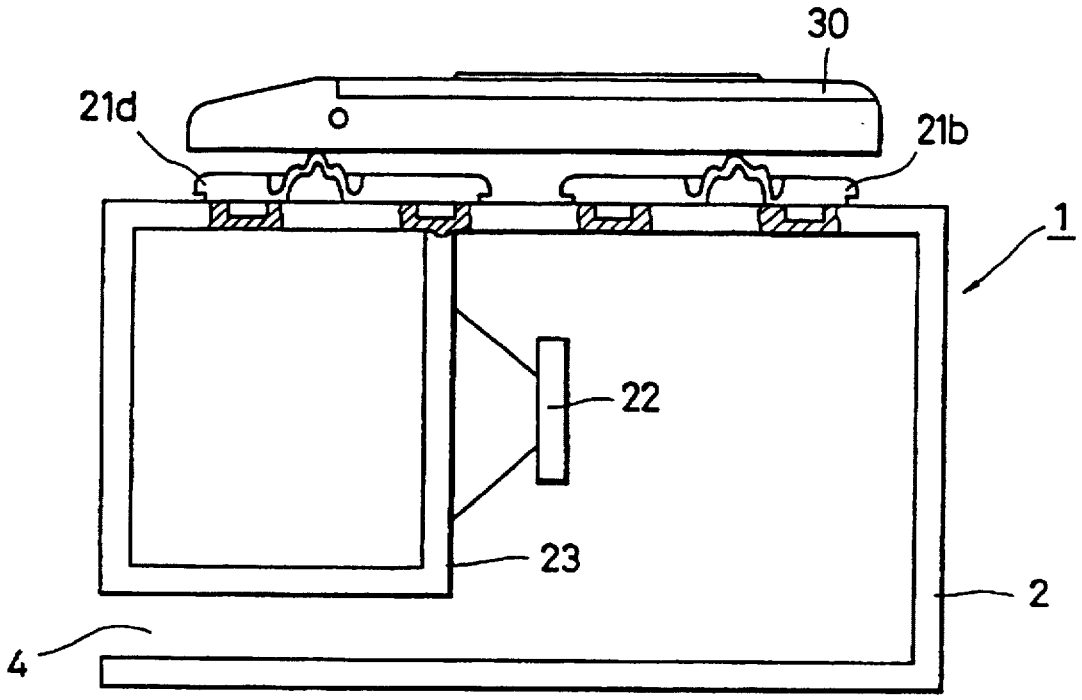
FIG. 7 is a cross-sectional view of an internal structure of the speaker system according to the present invention.

The cabinet 2 has a lower stepped portion 3 integrally formed with the bottom panel thereof having an elliptical cylindrical shape smaller than the upper surface thereof. As shown in FIGS. 3, 6, and 7, a rectangular port 4 is defined in a front region of the front half member 2A of the lower stepped portion 3 of the cabinet 2.

The front half member 2A of the cabinet 2 will first be described below with reference to FIGS. 3, 4, and 6. The front half member 2A supports, above the port 4, a level adjustment knob 5 for a speaker unit producing sounds in low frequencies, i.e., a woofer, housed in the cabinet 2, a master volume adjustment knob 6, and a power supply ON/OFF switch 7.

As shown in FIGS. 4 through 6, a rear protrusion 8 for attachment of input and output terminals is integrally formed with a rear surface of the rear half member 2B which is of a semicylindrical shape.

Figure 8:
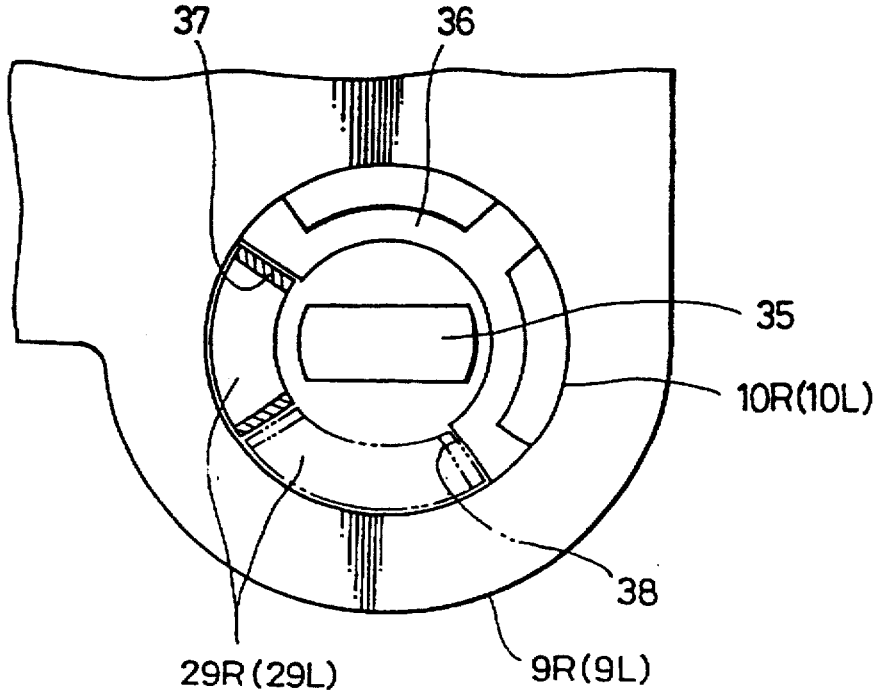
FIG. 8 is a plan view illustrating an attachment structure for a second baffle.

As shown in FIG. 5, the rear protrusion 8 comprises a substantially rectangular portion 8A as viewed from the rear of the cabinet 2. The rectangular portion 8A has left and right corners 9L, 9R on its upper end which have respective through holes 10L, 10R defined in their upper surfaces, as shown in FIGS. 6 and 8.

The rectangular portion 8A supports thereon a power supply connector 11 for energizing a single-channel amplifier for the speaker unit (the woofer), which constitutes a first baffle, for producing sounds in low frequencies ranging from 50 to 200 Hz, or a two-channel amplifier for speaker units (squakers and/or tweeters), which constitute second baffles, for producing sounds in middle and high frequencies ranging from 200 Hz to 20 kHz, and also supports thereon output terminals (DIN terminals) 12L, 12R of the amplifier which energizes the squakers and/or tweeters. The first baffle corresponds to a cross-sectional area taken across the cabinet 2 along a plane parallel to the sheet of FIG. 3.

The rectangular portion BA also supports screw retainers 14L, 14R by which there are angularly movably held joint bases 13L, 13R, respectively, that are joined to housings which house the speaker units serving as squakers and/or tweeters, constituting the second baffles. The second baffles correspond to cross-sectional areas taken across the housings which house the squakers and/or tweeters along a plane parallel to the sheet of FIG. 3.

The rectangular portion 8A also has a substantially square recess 15 defined therein between the left and right corners 9L, 9R and has connector terminals such as RCA pin connectors 17L, 17R for connecting the amplifiers in the cabinet 2 to a portable or small-size electronic device 30 such as a portable magnetic recording and reproducing device, a CD (Compact Disc) reproducing device, or a recording and reproducing device for a recordable and reproducible disc, and a DC power supply terminal 18 for supplying DC electric current to the portable or small-size electronic device 30.

As shown in FIGS. 4 and 5, legs 18L, 18R which have substantially the same height as the lower stepped portion 3 are integrally formed with the bottom of the rear protrusion 8.

As shown in FIG. 6, a damper attachment 19 comprising an aluminum disc 19A is mounted on the upper surface of the cabinet 2 which is composed of the front and rear half members 2A, 2B that are integrally combined with each other. Dampers 21*a*, 21*b*, 21*c*, 21*d* made of rubber or the like are detachably fitted in respective through holes 20*a*, 20*b*, 20*c*, 20*d* in the aluminum disc 19A in respective four quadrants thereof.

As shown in FIG. 7, the dampers 21*a*~21*d* serve to block vibrations from a woofer 22 in the cabinet 2 when a portable or small-size electronic device 30 that is powered by a primary or secondary cell is placed on the cabinet 2. The structure of the dampers 21*a*~21*d* will be described below with reference to FIGS. 7 and 9A~9D.

The cabinet 2 that is of an elliptical shape in plan, which is composed of the front and rear half members 2A, 2B that are integrally combined with each other, has an upper panel on which the aluminum disc 19A of the damper attachment 19 is mounted. The aluminum disc 19A is of an elliptical shape which is substantially the same as the shape in plan of the cabinet 2.

The through holes 20*a*, 20*b*, 20*c*, 20*d* of elliptical shape are defined in the aluminum disc 19A in the respective four quadrants thereof on a circle spaced from the center position of the aluminum disc 19A. The dampers 21*a*~21*d* as shown in FIGS. 9A~9D are detachably fitted in the respective through holes 20*a*, 20*b*, 20*c*, 20*d*.

Figure 9A:
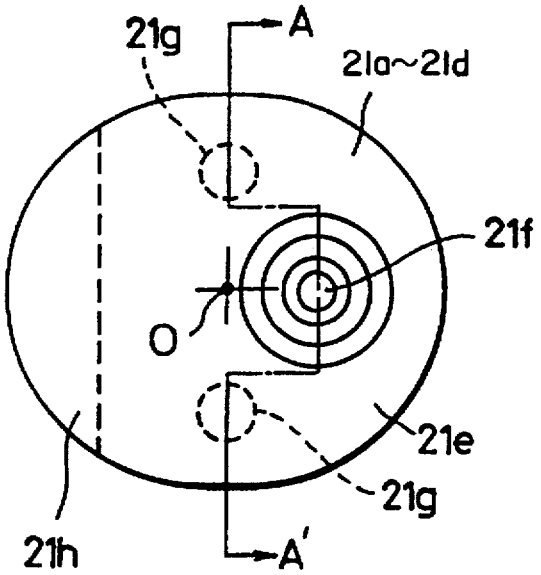
FIGS. 9A–9D show dampers used in the speaker system according to the present invention, FIG. 9A being a front elevational view of the dampers, FIG. 9B a side elevational view of the dampers, FIG. 9C a rear elevational view of the dampers, and FIG. 9D a cross-sectional view taken along line A–A' of FIG. 9A.
Figure 9D:
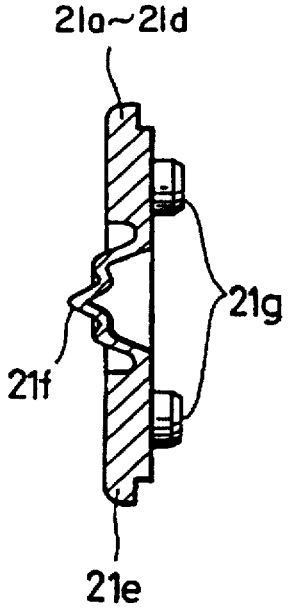
Figure 9B:
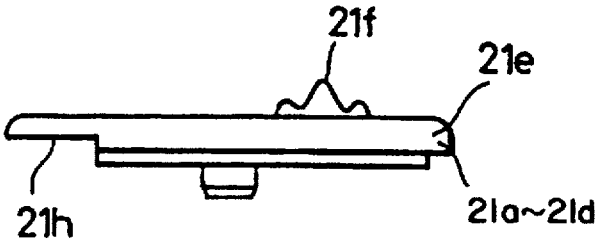
Figure 9C:
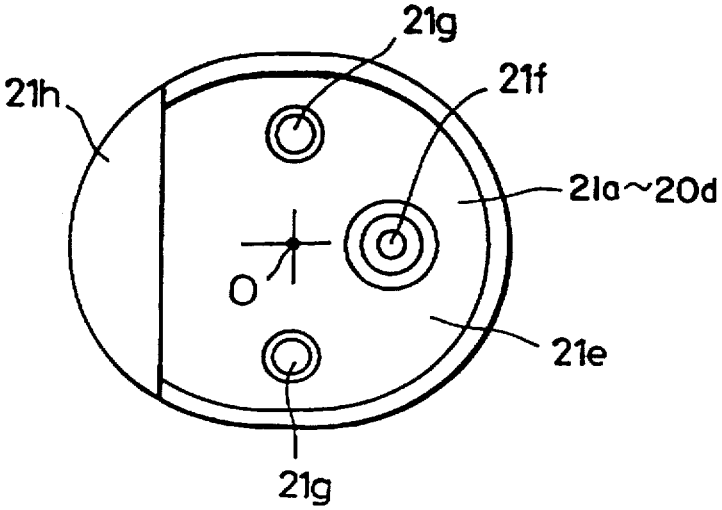

FIGS. 9A~9D show the dampers 21*a*~21*d*. FIG. 9A is a plan view of the dampers 21*a*~21*d*. FIG. 9B is a side elevational view of the dampers 21*a*~21*d*. FIG. 9C is a bottom view of the dampers 21*a*~21*d*. FIG. 9D is a cross-sectional view taken along line A–A' of FIG. 9A.

The dampers 21*a*~21*d* are made of rubber, elastomer, viscous rubber, or the like, and have a substantially elliptical shape. The dampers 21*a*~21*d* each have a projection 21*f* on its upper surface at a position displaced from a central point 0 where the major and minor axes of an elliptical base 21*e* intersect with each other. The projection 21*f* serves to contact the bottom of the electric device 30. The projection 21*f* has a circular shape and an inverted dish- and bellows-shaped, thin cross- sectional shape with a central projecting member, such that the projection 21*f* has larger compliance than the base 21*e*.

As shown in FIGS. 9B~9D, two bosses 21*g* for fitting into respective through holes defined in the cabinet 2 are disposed on the reverse side of the base 21*e*. The bosses 21*g* are spaced certain distances from the central point 0 along the major axis. The base 21*e* also has a segmental recess 21*h* defined in the reverse side thereof remote from the projection 21*f*, which is about half the thickness of the base 21*e*.

Figure 10:
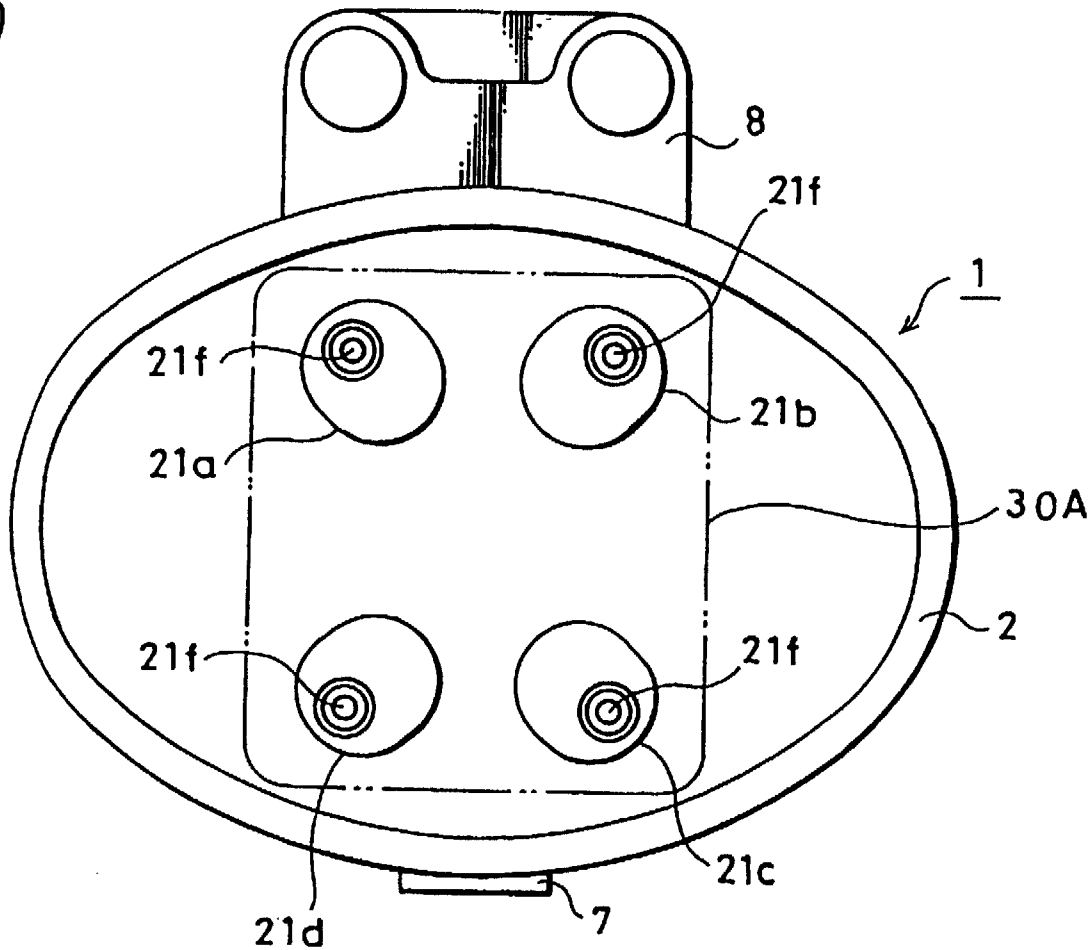
FIG. 10 is a view showing an example of an electronic device being supported by the dampers.
Figure 11:
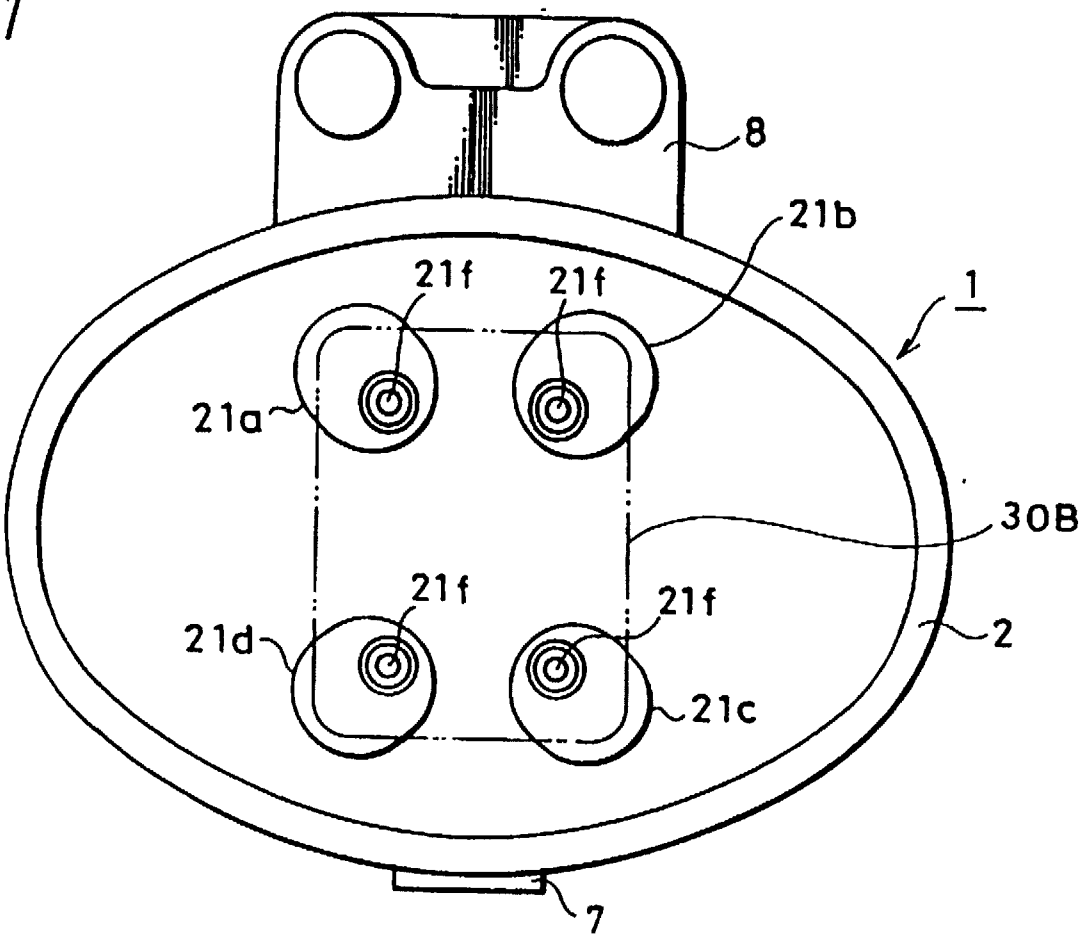
FIG. 11 is a view showing another example of an electronic device being supported by the dampers.

When the four dampers 21*a*~21*d* are fitted respectively into the through holes 20*a*~20*d*, not shown in FIG. 10, in the aluminum disc 19A such that the projections 21*f* thereof are oriented outwardly as shown in the cross-sectional view of FIG. 7 and the plan view of FIG. 10, it is possible to place on the dampers 21*a*~21*d* a device having a relatively large bottom surface such as a first portable electronic device 30A. When the four dampers 21*a*~21*d* are fitted respectively in the through holes 20*a*~20*d* in the aluminum disc 19A such that the projections 21*f* thereof are oriented inwardly as shown in FIG. 11, it is possible to place on the dampers 21*a*~21*d* a device having a relatively small bottom area such as a second portable electronic device 30B. The segmental recesses 21*h* of the dampers 21*a*~21*d* are formed such that the dampers 21*a*~21*d* can easily be removed from the through holes 20*a*~20*d* in the aluminum disc 19A when the dampers 21*a*~21*d* are pressed at the segmental recesses 21*h*. Each of the dampers 21*a*~21*d* may be in the form of a combination of a coil spring or rubber and oil of high viscosity, rather than rubber or the like only.

The cabinet 2 composed of the front and rear half members 2A, 2B has an internal structure as shown in FIG. 7. In FIG. 7, the cabinet 2 has a port 4 defined in a lower end thereof, thus functioning as a Bass-Reflex Cabinet which is also referred to as a Baffle in the present specification.

As shown in FIG. 7, the cabinet 2 has a baffle 23 with the woofer 22 mounted thereon. The cabinet 2 houses the single-channel amplifier for the woofer 22, and also the two-channel amplifiers for speaker units housed in the housings (described later on).

The joint bases 13L, 13R will be described below. The joint bases 13L, 13R are made of synthetic resin and have cylindrical shapes with round upper ends. The joint bases 13L, 13R have respective through holes 25L, 25R defined therein which extend obliquely from one side of the round upper ends downwardly to the other side thereof. Arms or pipes 26L, 26R are inserted and fixed in the through holes 25L, 25R, respectively, on one side of the round upper ends. The joint bases 13L, 13R have respective second through holes 25L', 25R' defined below and communicating with the respective through holes 25L, 25R. Leads 12L', 12R' extending respectively from the amplifier output terminals 12L, 12R are inserted through the respective through holes 25L', 25R', extend through the respective pipes 26L, 26R, and are connected to the respective speaker units as the squakers and/or tweeters in housings 27L, 27R shown in FIGS. 3 and 4.

The joint bases 13L, 13R of cylindrical shape have respective stepped portions 28L, 28R, as shown in FIG. 5, that are angularly movably disposed respectively in the through holes 10L, 10R defined in the corners 9L, 9R, as shown in FIG. 8. Stoppers 29L, 29R of metal or the like, which are in the shape of an omega, Ω, are attached to the respective lower ends of the stepped portions 28L, 28R.

Shaft insertion holes of semicylindrical cross section are defined upwardly in the bottoms of the stepped portions 28L, 28R, and shafts of semicylindrical cross section are inserted in the respective shaft insertion holes and fixed to the respective joint bases 13L, 13R by respective screws 31L, 31R. The shafts have respective tip ends angularly movable with respect to couplings 32L, 32R. To the lower ends of the couplings 32L, 32R, there are fixed respective flat fixing shafts 33L, 33R with opposite sides thereof being ground longitudinally which have through holes with threads 34L, 34R.

With the fixing shafts 33L, 33R being fixed to the joint bases 13L, 13R, the shaft assemblies including the joint bases 13L, 13R are freely angularly movable clockwise or counterclockwise above the couplings 32L, 32R.

The fixing shafts 33L, 33R fixed to the joint bases 13L, 13R are inserted in flat fixing holes 35 (see FIG. 8) in the through holes 10L, 10R in the corners 9L, 9R, and screws are inserted from the screw retainers 14L, 14R on the rear surface of the rear half member 2B shown in FIG. 5 into mesh with the threads 34L, 34R in the fixing shafts 33L, 33R. The joint bases 13L, 13R to which the second baffles 27L, 27R are connected through the pipes 26L, 26R are now angularly movably attached to the cabinet 2. When the screws are removed from the screw retainers 14L, 14R, the first baffle and the second baffles, i.e., the cabinet 2 and the housings 27L, 27R, are detached from each other. When the cabinet 2 and the housings 27L, 27R are detached from each other, they can be packed in a small size for delivery or the like.

As shown in FIG. 8, engaging portions 36 are formed in the through holes 10L, 10R in the corners 9L, 9R, respectively. The engaging portions 36 have engaging ends 37, 38 for engaging opposite ends of the stoppers 29L, 29R, thereby keeping the joint bases 13L, 13R angularly movable horizontally within a predetermined angular range.

When the joint bases 13L, 13R are angularly moved clockwise (CW) or counterclockwise (CCW), the second baffles 27L, 27R are moved a certain range in the horizontal directions indicated by the arrows A, A' in FIG. 3.

The pipes 26L, 26R which interconnect the first baffle and the second baffles will be described below.

Figure 12:
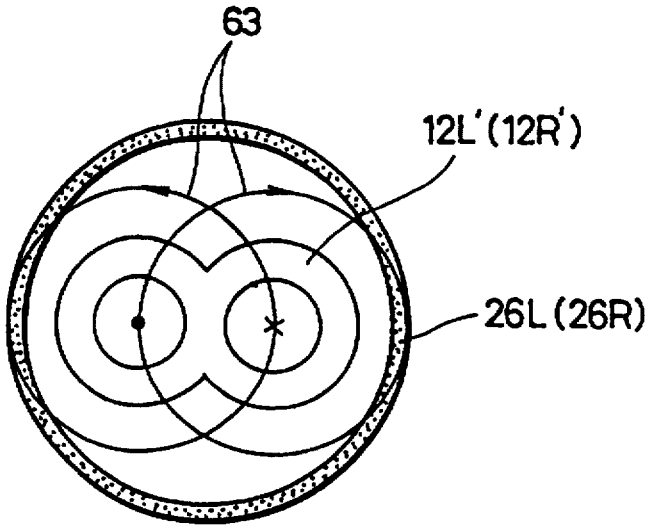
FIG. 12 is a view illustrative of a pipe used in the present invention.
Figure 13:
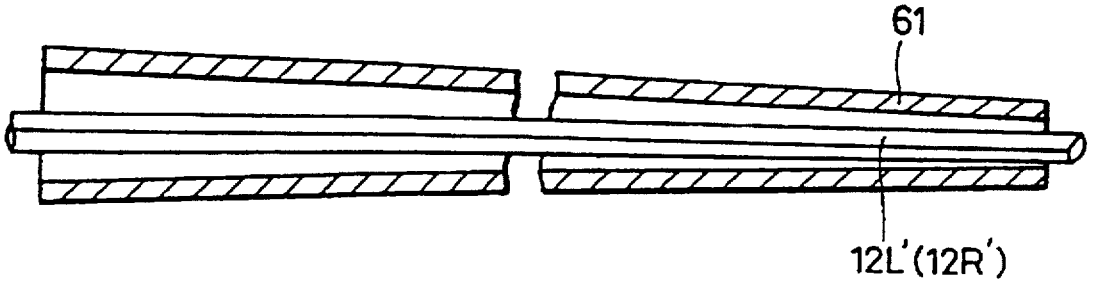
FIG. 13 is a cross-sectional view of another example of a pipe used in the present invention.

FIG. 12 is a cross-sectional view taken along line B–B' of FIG. 3. Each of the pipes 26L, 26R comprises a hollow cylindrical pipe produced by firing epoxy resin mixed with carbon fibers. As illustrated in FIG. 13, the pipes 26L, 26R are in the form of a tapered hollow pipe 61 having a thicker end to be inserted in the through holes 25L, 25R in the joint bases 13L, 13R and a thinner end to be pivotally connected to the squakers and/or tweeters of the second baffles 27L, 27R.

The pipes 26L, 26R, which serve as acoustic intermediate supports, are required to be light and hard, and have a moderate internal loss, i.e., are required to have a high sound speed ($\sqrt{E/\rho}$) where E is the Young's modulus and ρ the density) and a low Q (the sharpness of resonance). The pipes are comprised of a material capable of propagating sounds at a sound velocity of at least 5000 m/sec. and with a sharpness if resonance of at most 500 Hz. As shown in FIG. 17, the hollow pipe which contains mixed carbon fibers and a vibroisolating copper pipe sufficiently satisfy the above requirements.

Composite materials with mixed carbon fibers have strength and modulus of elasticity that vary depending on the process by which they are manufactured. Generally, it is preferable to manufacture such a composite material by carbonizing rayon or polyacrylonitrile fibers in an inert atmosphere and then graphitizing the carbonized fibers.

Though no physical quantities are shown in FIG. 17, tungsten wires may be degassed and processed into boron filaments in a reaction chamber, and the boron filaments may be bonded by epoxy resin to form a pipe. Alternatively, polyamide fibers (known as Kevlar, manufactured by Du Pont Ltd.) produced from p-phenylenediamine and terephthalic acid may be mixed with epoxy resin or glass fibers may be mixed with epoxy resin to form a pipe.

If the pipes 26L, 26R shown in FIG. 12 are metal pipes such as iron pipes as indicated in Table 1, then an eddy current is induced in the metal pipes by magnetic fluxes 63 that are generated by currents flowing through the leads 12L', 12R' which connect the speaker units and the driver circuits. These currents cause an electromagnetic induction tending to pass opposite currents in the leads 12L', 12R' which affect output currents to be supplied to the speaker units thus lowering the quality of sounds reproduced from the speaker units. If the pipes 26L, 26R are made of carbon fiber or Kevlar, which have a certain resistance according to this embodiment, then the reduction in the sound quality due to an electromagnetic induction can be avoided. FIG. 18 shows sound qualities depending on the resistances of those pipes.

In FIGS. 17 and 18, the sound qualities are achieved when the leads are inserted through the pipes 26L, 26R. The symbol ○ indicates a good sound quality, the symbol Δ a lower sound quality, and the symbol x a bad sound quality.

The length of the pipes 26L, 26R is selected as follows: If the length of the pipes 26L, 26R is too small, then since the housings 27L, 27R would be positioned closely to the cabinet 2, no stereophonic effect would be produced by reproduced sounds, and sounds outputted from the woofer 22 housed in the cabinet 2 would interfere with the housings 27L, 27R. If the length of the pipes 26L, 26R is too large, then since the housings 27L, 27R would be too far away from each other, no stereophonic effect would be achieved.

Therefore, the length of the pipes 26L, 26R may be selected such that a good stereophonic effect will be achieved when the listener listens to sounds reproduced by the speaker system and sounds reproduced by the woofer 22 will not interfere with the housings 27L, 27R.

The housings 27L, 27R mounted on the distal ends of the respective pipes 26L, 26R will be described below. The housings 27L, 27R are of a spherical form having an elliptical front shape with a major axis of about 100 mm and accommodate speaker units for producing sounds in middle and high frequencies. The housings 27L, 27R are mounted on the respective distal ends of the pipes 26L, 26R for angular movement about respective shafts 41L, 41R in a direction from the viewer of FIG. 4 toward FIG. 4 or from FIG. 4 toward the viewer of FIG. 4. Therefore, the housings 27L, 27R can rock horizontally about the respective pipes 26L, 26R in FIG. 3. Speaker units that serve as squakers and/or tweeters are attached to respective front sides of attachment plates of the housings 27L, 27R. The housings 27L, 27R have protective members of slender elements mounted on the front sides thereof for projecting the sound-radiating surfaces of the speaker units. As described above, the second baffles are represented by cross-sectional areas taken across the housings 27L, 27R along a plane parallel to the sheet of FIG. 3.

Figure 1:
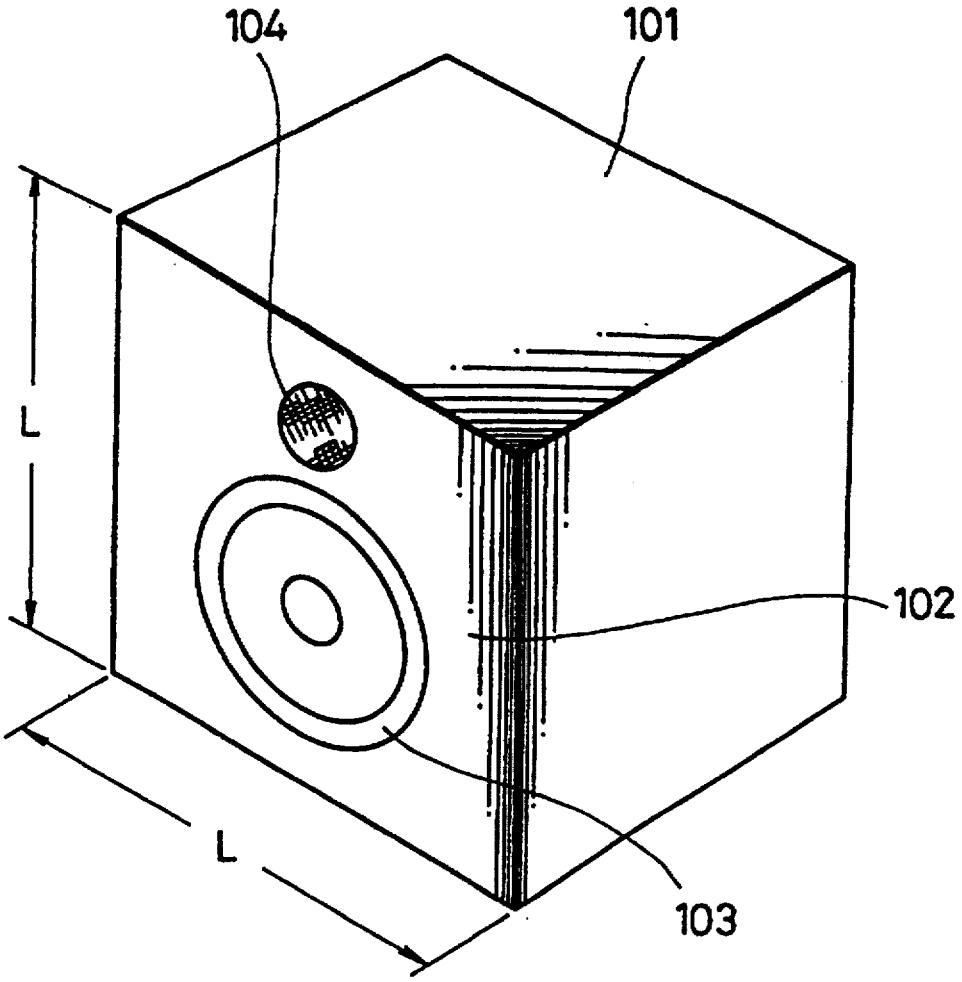
FIG. 1 is a perspective view of a speaker system which serves as a basis for the present invention.
Figure 2:
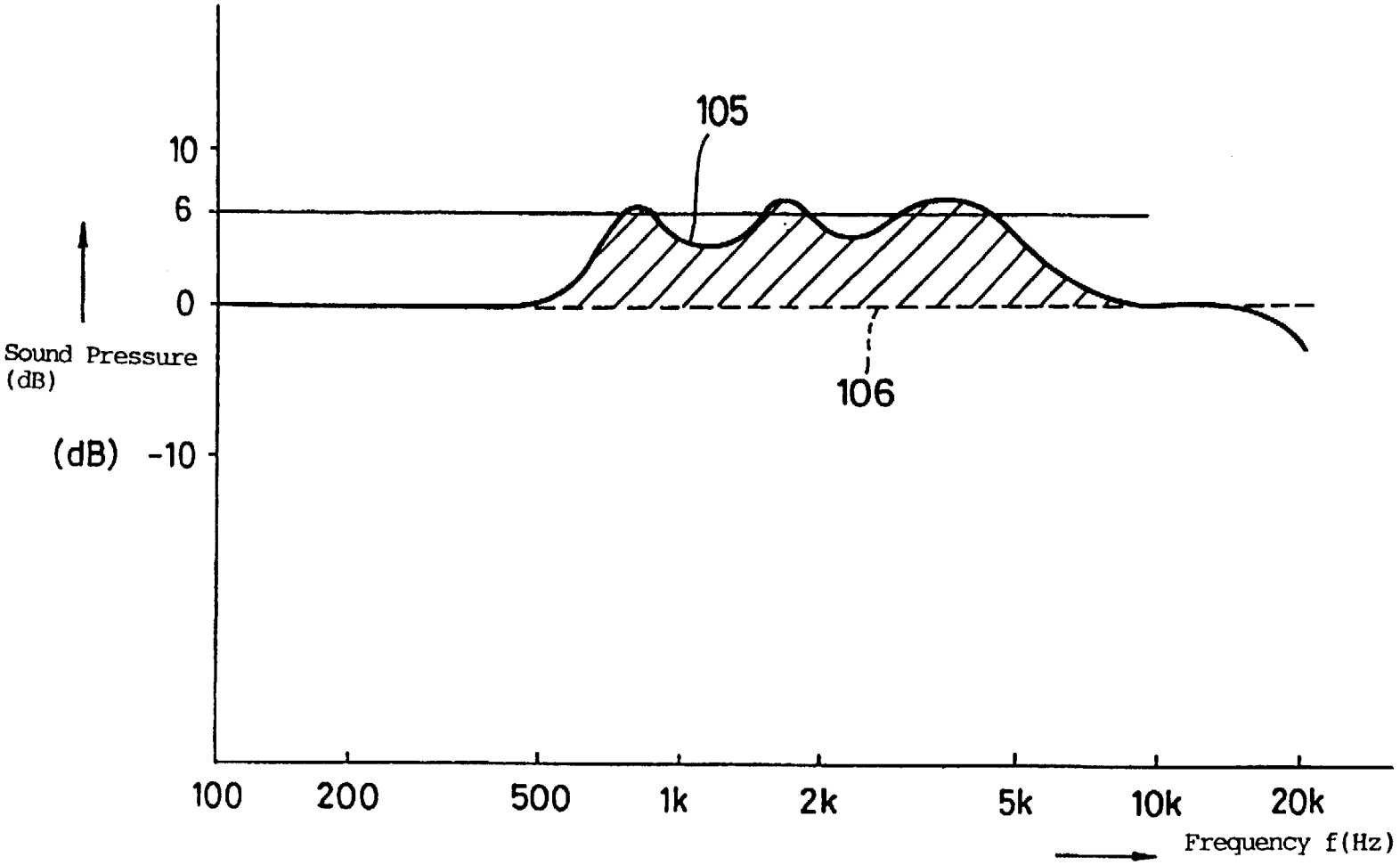
FIG. 2 is a diagram showing frequency characteristics of the speaker system shown in FIG. 1.

Because the major axis of each of the housings 27L, 27R which house the speaker units for producing sounds in middle and high frequencies is of about 100 mm, the length L is 0.1 mm, and the wavelength $\lambda$, 2L, is $2\times0.1=0.2$ m and the frequency f, $v/\lambda$ is $340/0.2=1700$ (Hz) as described above with reference to FIG. 1.

Figure 14:
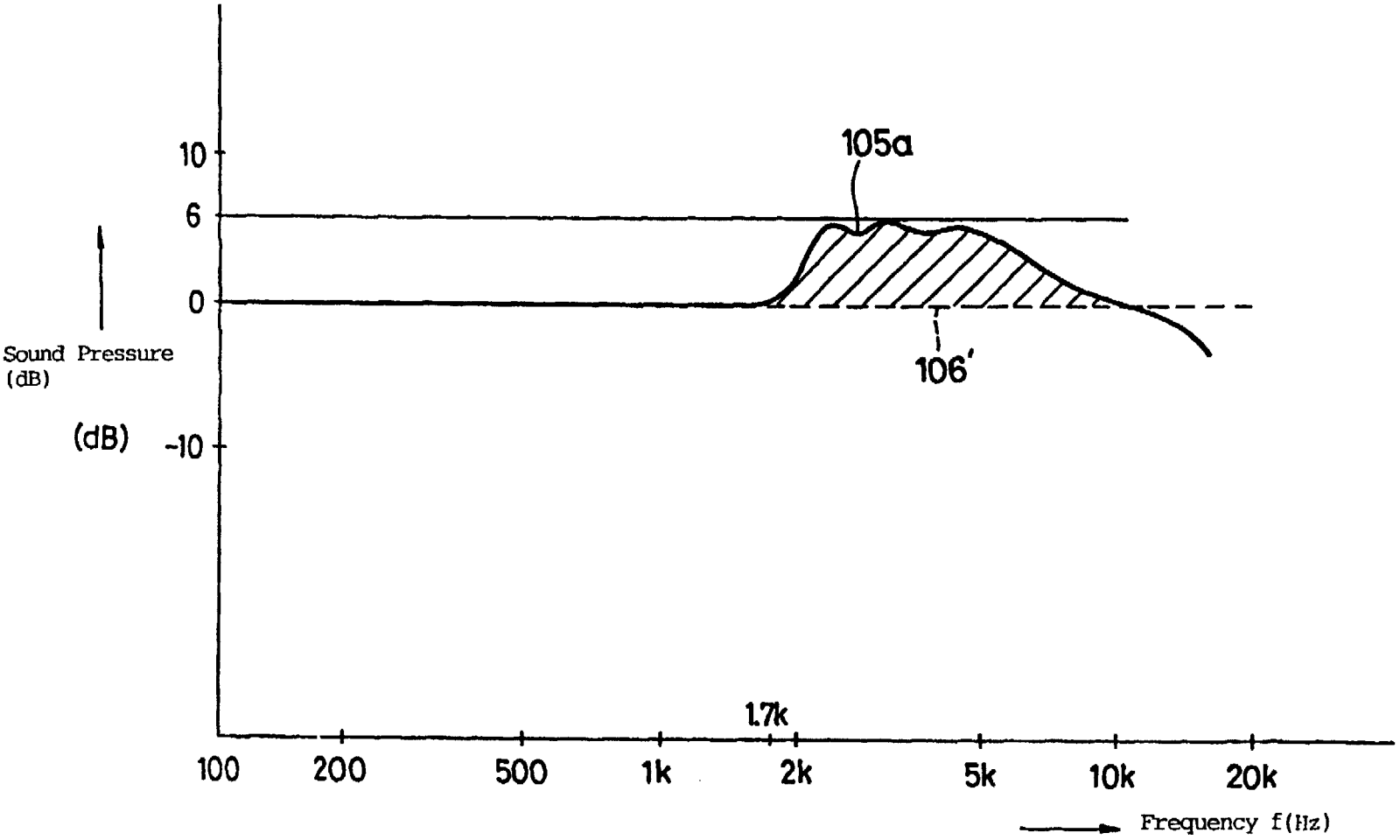
FIG. 14 is a diagram showing frequency characteristics of the speaker system according to the present invention.

If the first and second baffles are separated from each other and the length L of each side of the first baffle, i.e., the cabinet 2 is L=0.34 m, then when the major axis of each of the second baffles, i.e., the housings 27L, 27R, is reduced to L=0.1 m, the frequency characteristic curve of the speaker system according to the present invention, which is based on both direct sounds and indirect sounds (reflected sound waves), is indicated by 105*a* in FIG. 14. The hatched area representing the difference between the direct sounds and indirect sounds produced by the speaker system according to the present invention is half or less than half the corresponding hatched area of the speaker system shown in FIG. 1. Specifically, the reflected sound waves as indirect sounds, which are responsible for a reduction in the sound quality, are reduced, thereby reducing the baffle effect for reproducing sounds with high-fidelity sound quality. While the length L of the first baffle is 0.34 m in the above example, the speaker system according to the present invention has been confirmed as being sufficiently effective if the length L is 0.2 m, that is about twice the length of the major axis of the second baffles.

Furthermore, inasmuch as the first baffle and the second baffles are integrally joined to each other by the pipes, the installation area required by the speaker system according to present invention is reduced by about ¼ of the installation area required by small-size component-type systems.

Figure 15:
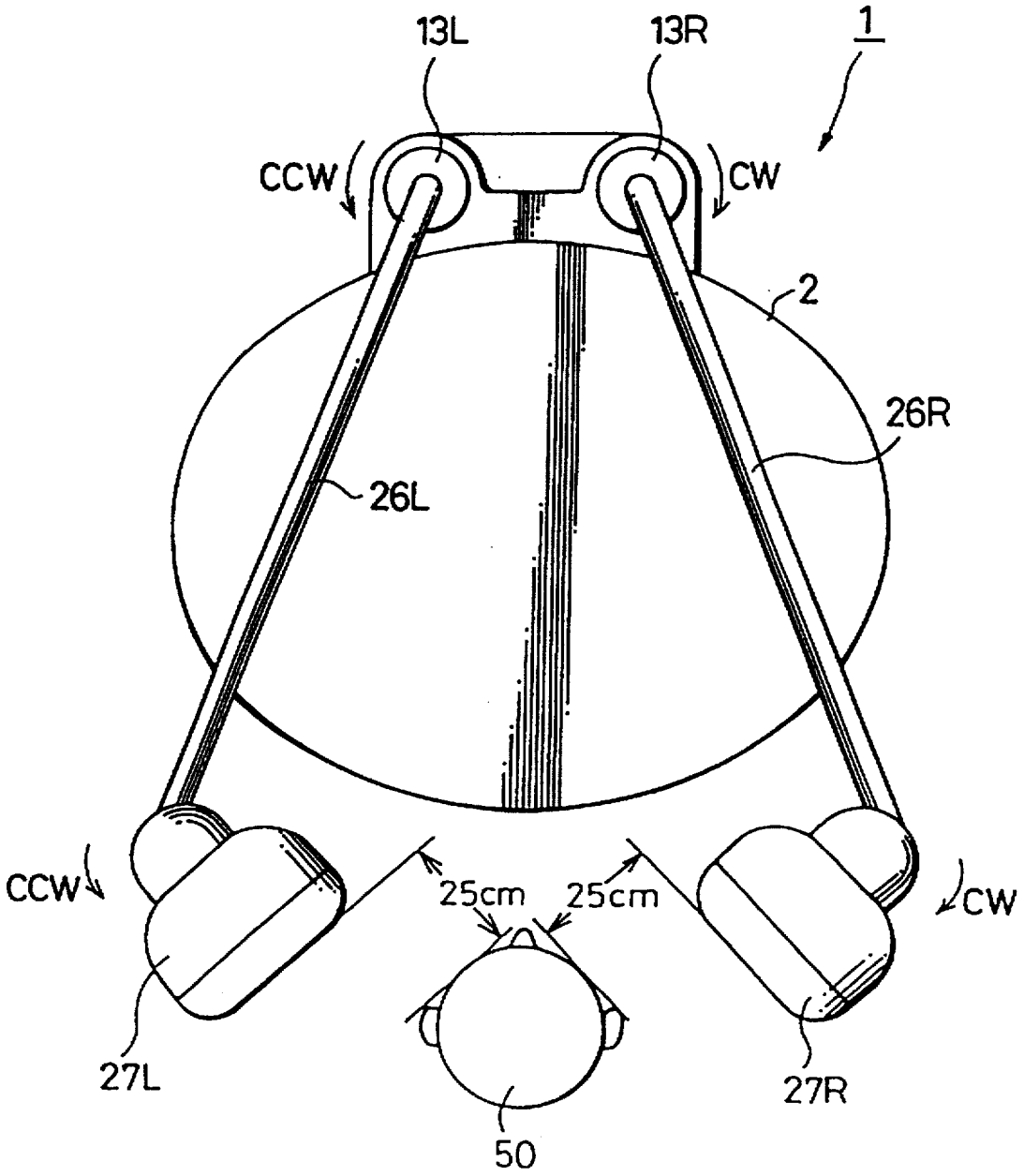
FIG. 15 is a view illustrative of the manner in which the speaker system according to the present invention operates.

FIG. 15 shows in front elevation the speaker system according to the present invention. As shown in FIG. 15, it is assumed that a listener 50 positioned in front of the speaker system 1 turns the housing 27L counterclockwise (CCW) with respect to the joint base 13L and the pipe 26L and also turns the housing 27R clockwise (Cw) with respect to the joint base 13R and the pipe 26R until the housings 27L, 27R are positioned closely to the ears of the listener 50. If the second baffles 27L, 27R are spaced at a distance of 25 cm, for example, from the ears of the listener 50, then assuming that the normal distance for the speaker units to produce sounds in middle and high frequencies is at least 1 m, $20\log100/25=12$ dB, and the listener 50 can listen to sounds that are 12 dB louder, provided the intensity of sounds from the speaker units remains the same. Conversely, if the listener wants to listen to sounds at the same sound level, then the intensity of sounds from the speaker units can be reduced 12 dB, and hence the intensity of leakage sounds (noises) can be lowered.

Figure 16:
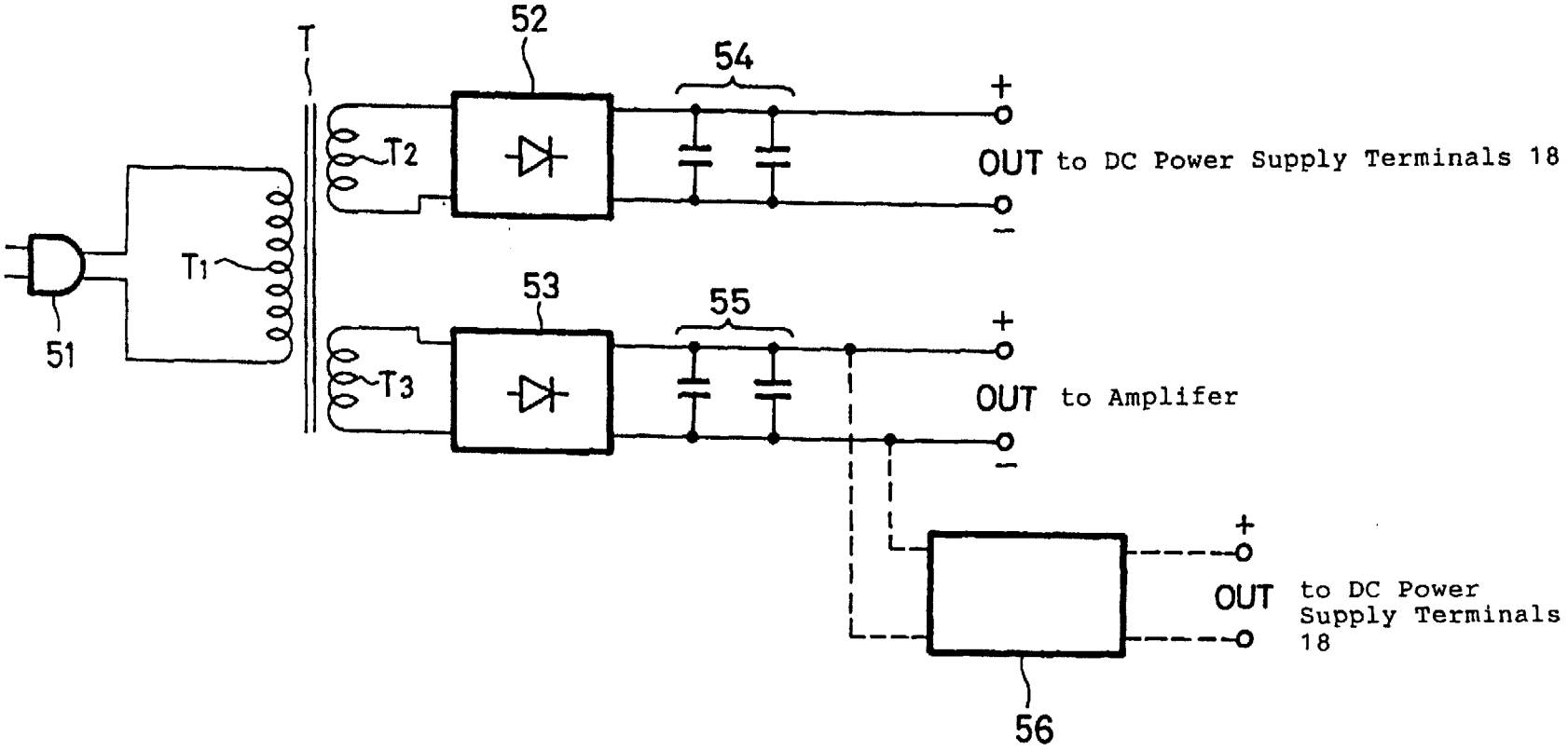
FIG. 16 is a circuit diagram of a DC power supply circuit used in the speaker system according to the present invention.

FIG. 16 shows a DC power supply circuit for the amplifier housed in the cabinet 2. In FIG. 16, a plug 51 extends from the power supply connector 11 shown in FIG. 5 on the rear projection 8. When the plug 51 is connected to a commercial power supply system, it supplies a commercial voltage to a primary winding $T_1$ of a power transformer T. The power transformer T also has a secondary winding $T_2$ to be connected to the DC power supply terminal 18 on the rear projection 8 of FIG. 5, and another secondary winding $T_3$ to be connected to the amplifier. Secondary voltages from these secondary windings $T_2$, $T_3$ are converted to DC voltages of 4.5 V and 9 V, for example, by rectifying blocks 52, 53 and smoothing circuits 54, 55. The DC voltage of 4.5 V is then supplied to the DC power supply terminal 18, and the DC voltage of 9 V is supplied to the amplifier.

The secondary winding $T_2$ for supplying the DC voltage to the DC power supply terminal 18 may be dispensed with, and the DC voltage of 9 V from the rectifying block 55 may be converted by a DC/DC converter 56 (indicated by the broken lines) into a DC voltage of 4.5 V to be supplied to the DC power supply terminal 18.

The DC power supply terminal 18 can be connected to DC input terminals of the electronic devices 30, 30A, 30B. Such a connection is much simpler than connecting wires which would otherwise be needed behind the cabinet 2 to connect a DC power supply to the electronic devices 30, 30A, 30B using an AD adapter or the like. Connecting wires are also required to connect output terminals of the electronic devices 30, 30A, 30B to the connector terminals (pin connectors) 17L, 17R that are connected to the amplifiers in the cabinet 2 as shown in FIG. 5.

In the speaker system according to the present invention, the dampers are mounted on the cabinet which houses the woofer only. The dampers may also be mounted on a general speaker cabinet.

In the above described embodiment of the present invention, the woofer is housed in the cabinet. However, because sounds reproduced by the woofer are of low frequencies and have no directivity, the woofer may not necessarily be positioned intermediate between the squakers and/or tweeters, but may be positioned below one of the squakers and/or tweeters.

Since the second baffles may be smaller than the first baffle and may be spaced from the first baffle, the speaker system according to the present invention has a reduced baffle effect and can reproduce sounds with increased sound quality.

Inasmuch as the first baffle and the second baffles are spaced from each other and integrally joined to each other by the pipes, the installation area required by the speaker system according to present invention may be much smaller than the installation area required by small-size component-type systems.

We claim:

1. A stereo speaker system comprising:

a first baffle supporting a first speaker unit for producing sounds in a first frequency range;

a plurality of second baffles each supporting a respective second speaker unit for producing sounds in a second frequency range, said second frequency range being higher than the first frequency range, said second baffles being smaller than said first baffle;

said plurality of second baffles being spaced a predetermined distance from said first baffle; and a plurality of non-metallic hollow pipes each angularly movably connected at a first end to said first baffle and at a second opposite end pivotally connected to one of said second baffles so that each of said second baffles is attached to said first baffle for independent relative movement, said pipes having a length so that sounds from said first speaker unit and sounds from each second speaker unit do not interfere and so that sounds from said second speaker units cooperate to produce a stereophonic effect, wherein said plurality of second baffles can be independently moved toward and away from a listener, and wherein said pipes are tapered decreasing gradually in diameter from said first end to said second end and are integrally formed of a material made of epoxy resin mixed with carbon fibers so that the pipes have a resistance of at least 170 Ω/m and propagate sound at a velocity of at least 5000 m/sec with a sharpness of resonance of at most 500 Hz.

2. The speaker system according to claim 1, further comprising a cabinet with said first baffle mounted therein, and a duct connecting a cavity behind said first speaker unit to an exterior space; and a plurality of casings with said second baffles respectively mounted therein, wherein said plurality of pipes each have said first end attached to said cabinet and said second end attached to respective ones of said casings.

3. The speaker system according to claim 2, further comprising a first pivot support connected between each of said plurality of pipes and said cabinet, for supporting said plurality of pipes for angular movement with respect to said cabinet, and a second pivot support connected between each of said plurality of pipes and a corresponding one of said casings, for supporting said corresponding casings for angular movement with respect to respective ones of said plurality of pipes.

4. The speaker system according to claim 2, further comprising damper means mounted on an upper panel of said cabinet for supporting an electronic device thereon.

5. The speaker system according to claim 4, wherein said damper means comprises a plurality of dampers having respective support members for supporting the electronic device thereon, said support members being displaced from centers of said dampers.

6. A stereo speaker comprising:

a baffle supporting a first speaker unit for producing sounds in low frequencies;

a cabinet housing said baffle therein and having a port connecting a cavity behind said first speaker unit to an exterior space, said cabinet serving as a first baffle;

a plurality of casings each supporting second speaker units for producing sounds in middle or high frequencies, said casings being smaller than said first baffle and serving as second baffles;

a plurality of non-metallic hollow pipes each having a first end angularly movably attached to said cabinet and a second opposite end pivotally attached to one of said casings so that each of said plurality of casings are attached to said cabinet for independent relative movement; and each of said plurality of pipes having a length so that sounds from said second speaker units and said first speaker unit do not interfere and sounds from said second speaker units cooperate to produce a stereophonic effect, wherein said plurality of casings can be independently moved toward and away from a listener, and wherein said pipes are tapered decreasing gradually in diameter from said first end to said second end and are integrally formed of a material made of epoxy resin mixed with carbon fibers so that the pipes have a resistance of at least 170 Ω/m and propagate sound at a velocity of at least 5000 m/sec with a sharpness of resonance of at most 500 Hz.

7. The speaker system according to claim 6, further comprising a driver circuit disposed in said cabinet for driving said first speaker unit and said second speaker units, said driver circuit and each of said second speaker units being connected to each other by a signal line extending through respective ones of said plurality of pipes.

8. The speaker system according to claim 7, further comprising DC voltage output terminals mounted on said cabinet.

9. The speaker system according to claim 8, wherein said DC voltage output terminals are supplied with a controlled voltage extracted from a DC voltage supplied to said driver circuit.

* * * * *